US006194982B1

(12) United States Patent
Mrenna et al.

(10) Patent No.: US 6,194,982 B1
(45) Date of Patent: Feb. 27, 2001

(54) CIRCUIT INTERRUPTER WITH A MAGNETICALLY-INDUCED AUTOMATIC TRIP ASSEMBLY IMPLEMENTING A SPRING CLAMP

(75) Inventors: Stephen Albert Mrenna, Beaver; Craig Joseph Puhalla, Coraopolis; Daniel Edward Schiller, Limerick; Keith Edward Thomas, Burgettstown, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/494,706

(22) Filed: Jan. 31, 2000

(51) Int. Cl.[7] ..... H01H 77/00; H01H 83/00
(52) U.S. Cl. ..... 335/35; 335/23
(58) Field of Search ..... 335/21–25, 35–48, 335/167–176

(56) References Cited

U.S. PATENT DOCUMENTS 5,237,297 * 8/1993 Ellington et al. ..... 335/35
5,250,918 * 10/1993 Edds et al. ..... 335/35
5,294,902 * 3/1994 Pannenborg et al. ..... 335/35

* cited by examiner

*Primary Examiner*—Lincoln Donovan
(74) *Attorney, Agent, or Firm*—Charles E. Kosinski

(57) ABSTRACT

A circuit interrupter including a housing, separable main contacts disposed in the housing, and an operating mechanism disposed in the housing and interconnected with the contacts. A trip mechanism is disposed in the housing and has an automatic trip assembly that selectively generates a tripping operation to cause the operating mechanism to open the contacts upon a predetermined current threshold. The automatic trip assembly includes a magnetic yoke, an armature, and an electrical terminal. The magnetic yoke has pivot supports on which are positioned pivot arms of a head portion of the armature. A clamp member applies a clamping force to the head portion of the armature in a direction to normally rotationally displace a bottom portion of the armature away from the yoke and the terminal.

14 Claims, 8 Drawing Sheets

CIRCUIT INTERRUPTER WITH A MAGNETICALLY-INDUCED AUTOMATIC TRIP ASSEMBLY IMPLEMENTING A SPRING CLAMP

BACKGROUND OF THE INVENTION

1. Field of the Invention

The present invention relates to circuit interrupters generally and, more specifically, to those kinds of circuit interrupters having a trip mechanism including an automatic trip assembly for generating a magnetically-induced tripping operation.

2. Description of the Prior Art

Molded case circuit breakers and interrupters are well known in the art as exemplified by U.S. Pat. No. 4,503,408 issued Mar. 5, 1985, to Mrenna et al., and U.S. Pat. No. 5,910,760 issued Jun. 8, 1999 to Malingowski, et al., each of which is assigned to the assignee of the present application and incorporated herein by reference.

Circuit interrupters advantageously provide for automatic circuit interruption (opening of the contacts) when an overcurrent condition is determined to exist. One way of determining whether or not an overcurrent condition exists is to provide a trip mechanism with an automatic trip assembly that reacts to a magnetic field generated by the overcurrent condition. In such circuit interrupters, the reaction to the magnetic field is often in the form of a movement of an armature that, in turn, sets in motion a tripping operation. The movement of the armature normally is either away from or towards a magnetic structure from which the magnetic field emanates, and may be influenced by a member(s) which biases the armature away from the magnetic structure. The magnetic structure is connected to an electrical terminal of the conductor from which electrical current is received.

In the prior art, compression springs have sometimes been implemented in the automatic trip assembly in order to provide the aforementioned biasing of the armature away from the magnetic structure. It would be advantageous if an easier and more cost-effective way existed by which to provide this biasing.

SUMMARY OF THE INVENTION

The present invention provides a circuit interrupter that meets all of the above-identified needs.

In accordance with the present invention, a circuit interrupter is provided which includes a housing, separable main contacts disposed in the housing, and an operating mechanism disposed in the housing and interconnected with the contacts. Also provided is a trip mechanism disposed in the housing and having an automatic trip assembly that selectively generates a tripping operation to cause the operating mechanism to open the contacts upon a predetermined current threshold. The automatic trip assembly includes a magnetic yoke, an armature, and an electrical terminal. The magnetic yoke has pivot supports on which are positioned pivot arms of a head portion of the armature. The assembly also includes a clamp member applying a clamping force to the head portion of the armature in a direction to normally rotationally displace a bottom portion of the armature away from the yoke and the terminal.

This and other objects and advantages of the present invention will become apparent from a reading of the following description of the preferred embodiment taken in connection with the attached drawings.

DESCRIPTION OF THE PREFERRED EMBODIMENT

Figure 1:
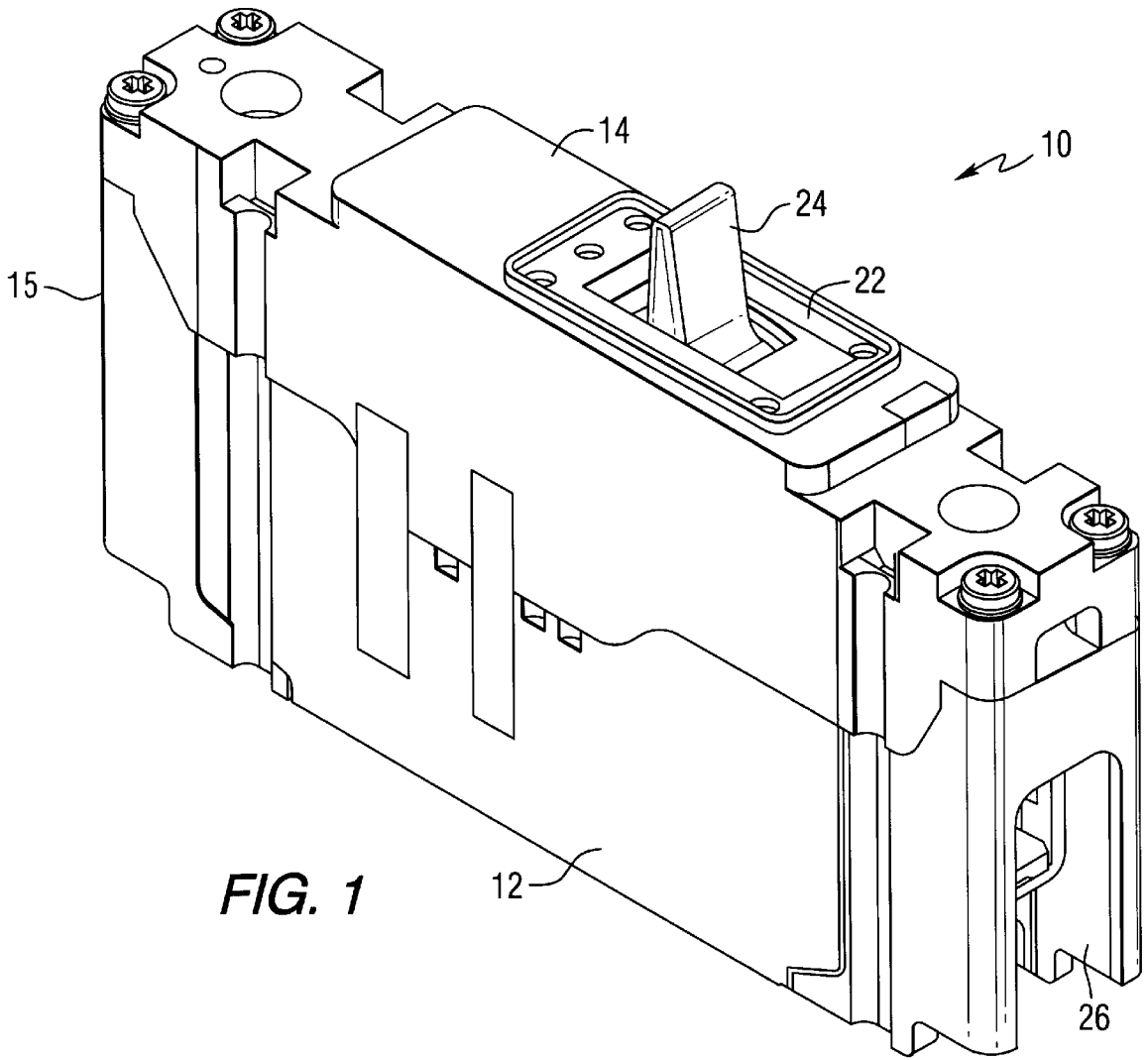
FIG. 1 is an orthogonal view of a molded case circuit breaker embodying the present invention.

Referring now to the drawings and FIG. 1 in particular, shown is a molded case circuit breaker 10. A detailed description of the general structure and operation of circuit breaker 10 can be found in U.S. patent application Ser. No. 09/385,111 and U.S. patent application Ser. No. 09/385,566, both disclosures of which are incorporated herein by reference. Briefly, circuit breaker 10 includes a base 12 mechanically interconnected with a cover 14 to form a circuit breaker housing 15. Cover 14 includes a handle opening 22 through which protrudes a handle 24 that is used in a conventional manner to manually open and close the contacts of circuit breaker 10 and to reset circuit breaker 10 when it is in a tripped state. Handle 24 may also provide an indication of the status of circuit breaker 10 whereby the position of handle 24 corresponds with a legend (not shown) on cover 14 near handle opening 22 which clearly indicates whether circuit breaker 10 is ON (contacts closed), OFF (contacts open), or TRIPPED (contacts open due to, for example, an overcurrent condition). Also shown is a load conductor opening 26 in base 12 that shields and protects a load terminal (not shown). Although circuit breaker 10 is depicted as a single-phase circuit breaker, the present invention is not limited to single-phase operation.

Figure 2:
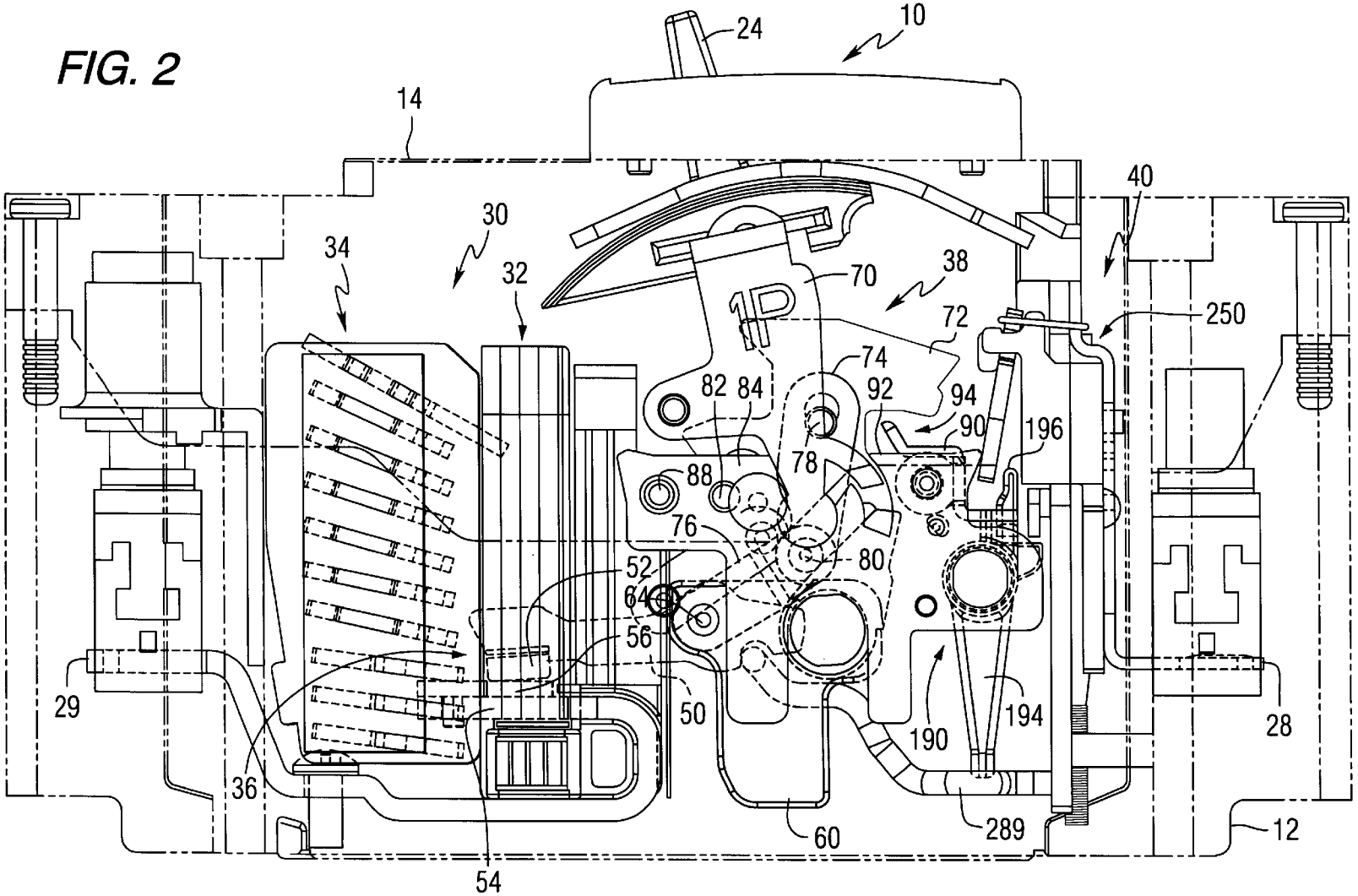
FIG. 2 is a side elevational view of an internal portion of the circuit interrupter of FIG. 1.

Referring now to FIG. 2, a longitudinal section of a side elevation, partially broken away and partially in phantom, of circuit breaker 10 is shown having a load terminal 28 and a line terminal 29. There is shown a plasma arc acceleration chamber 30 comprising a slot motor assembly 32 and an arc extinguisher assembly 34. Also shown is a contact assembly 36, an operating mechanism 38, and a trip mechanism 40 including a rotatable trip bar assembly 190 and an automatic trip assembly 250.

Contact assembly 36 comprises a movable contact arm 50 supporting thereon a movable contact 52, and a stationary contact arm 54 supporting thereon a stationary contact 56. Stationary contact arm 54 is electrically connected to line terminal 29 and movable contact arm 50 is electrically connected to load terminal 28. Also shown is a crossbar assembly 60 which traverses the width of circuit breaker 10 and is rotatably disposed on an internal portion of base 12. Actuation of operating mechanism 38 causes crossbar assembly 60 and movable contact arm 50 to rotate into or out of a disposition which places movable contact 52 into or out of a disposition of electrical continuity with fixed contact 56.

Operating mechanism 38 comprises a handle arm or handle assembly 70 (connected to handle 24), a configured plate or cradle 72, an upper toggle link 74, an interlinked lower toggle link 76, and an upper toggle link pivot pin 78 which interlinks upper toggle link 74 with cradle 72. Lower toggle link 76 is pivotally interconnected with upper toggle link 74 by way of an intermediate toggle link pivot pin 80, and with crossbar assembly 60 at a pivot pin 64. Provided is a cradle pivot pin 82 which is laterally and rotatably disposed between parallel, spaced apart operating mechanism support members or sideplates 84. Cradle 72 is free to rotate (within limits) via cradle pivot pin 82. A main stop bar 88 is laterally disposed between sideplates 84, and provides a limit to the counter-clockwise movement of cradle 72.

In FIG. 2, operating mechanism 38 is shown for the ON disposition of circuit breaker 10. In this disposition, contacts 52 and 56 are closed (in contact with each other) whereby electrical current may flow from load terminal 28 to line terminal 29.

Operating mechanism 38 will assume the TRIPPED disposition of circuit breaker 10 in certain circumstances. The TRIPPED disposition is related (except when a manual tripping operation is performed) to an automatic opening of circuit breaker 10 caused by the thermally or magnetically induced reaction of trip mechanism 40 to the magnitude of the current flowing between load conductor 28 and line conductor 29. The operation of trip mechanism 40 is described in detail below. For purposes here, circumstances such as a load current with a magnitude exceeding a predetermined threshold will cause trip mechanism 40 to rotate trip bar assembly 190 clockwise (overcoming a spring force biasing assembly 190 in the opposite direction) and away from an intermediate latch 90. This unlocking of latch 90 releases cradle 72 (which had been held in place at a lower portion 92 of a latch cutout region 94) and enables it to be rotated counter-clockwise under the influence of tension springs (not shown) interacting between the top of handle assembly 70 and the intermediate toggle link pivot pin 80. The resulting collapse of the toggle arrangement causes pivot pin 64 to be rotated clockwise and upwardly to thus cause crossbar assembly 60 to similarly rotate. This rotation of crossbar assembly 60 causes a clockwise motion of movable contact arm 50, resulting in a separation of contacts 52 and 56.

Circuit breaker 10 includes automatic thermal and magnetic tripping operations which can cause trip bar assembly 190 to rotate in the clockwise direction and thereby release cradle 72. Automatic trip assembly 250 of trip mechanism 40, positioned in close proximity to trip bar assembly 190, enables these tripping operations to be provided.

Referring now also to FIGS. 3–12, shown in isolation is automatic trip assembly 250 and its various components. Assembly 250 includes a magnetic yoke 252, a bimetal 254, a magnetic clapper or armature 256, load terminal 28, and a spring clamp or spring clip 400. Magnetic yoke 252 (FIGS. 5 and 6) includes a substantially planar portion 258 with a bottom portion 258A. Protruding from portion 258 are curved arms or wings 260 and 262 having front faces 260A and 262A. At the tops of arms 260 and 262 are pivot supports 264 and 266, with respective pivot surfaces 268 and 270 on which pivot magnetic clapper 256, as described below. Pivot support 264 includes a front retaining ridge or raised surface 263 that helps define pivot surface 268, and pivot support 266 includes a downwardly facing stop or protrusion 265. Pivot supports 264 and 266 each include a rear retaining protrusion 267 which helps define pivot surfaces 268 and 270. Yoke 252 also includes a shoulder portion 272 above which is positioned a portion of load terminal 28, as described below. In addition, holes or openings 274 are formed through substantially planar portion 258 for purposes described below. Yoke 252 of the exemplary embodiment is made of carbon steel material of approximately 0.078 inch thickness.

Bimetal 254 (FIG. 7) is planar and substantially rectangular in form and includes two cutout regions 280 and 282 forming a neck 284 upon which sits a head portion 286. Through a bottom portion 287 of bimetal 254 is a hole or opening 288 for purposes described below. Bimetal 254 is structured as is known to one of skill in the art such that bottom portion 287 deflects (bends) in a conventional manner above certain temperatures.

Magnetic clapper 256 (FIG. 8) is planar in form and includes cutout regions 312 and 314 which form shoulders 313 and 315, a neck portion 311, and a head portion 316. Head portion 316 includes horizontal pivot portions or arms 318A and 318B, and an indent or recess 320 that, in the exemplary embodiment, is circular in shape and positioned substantially adjacent to arm 318A. Indent 320 may be positioned elsewhere in head portion 316, may be of a different shape, and may be a hole or opening instead, in alternative embodiments. The outside corner of shoulder 315 includes a chamfered region or cutout 317. Clapper 256 includes a bottom portion 319 and is formed of carbon steel material in the exemplary embodiment.

Load terminal 28 (FIGS. 9 and 10) includes a substantially planar portion 290 from which protrudes, in approximately perpendicular fashion, a bottom connector portion 292 that connects with an external input of electrical current by means of a connecting device such as a self-retaining collar which provides both a physical and electrical connection. Located at the other end of terminal 28 is a top substantially planar region 296 which is offset from portion 290 via a curved region 298. Planar region 296 includes an indent or recess 299 that, in the exemplary embodiment, is circular in shape and positioned closer to the right side of region 296 than the left (when viewed in FIG. 10). Indent 299 may be positioned elsewhere in planar region 296, may be of a different shape, and may be a hole or opening instead, in alternative embodiments. Formed through portion 290 are holes or openings 300.

Figure 12:
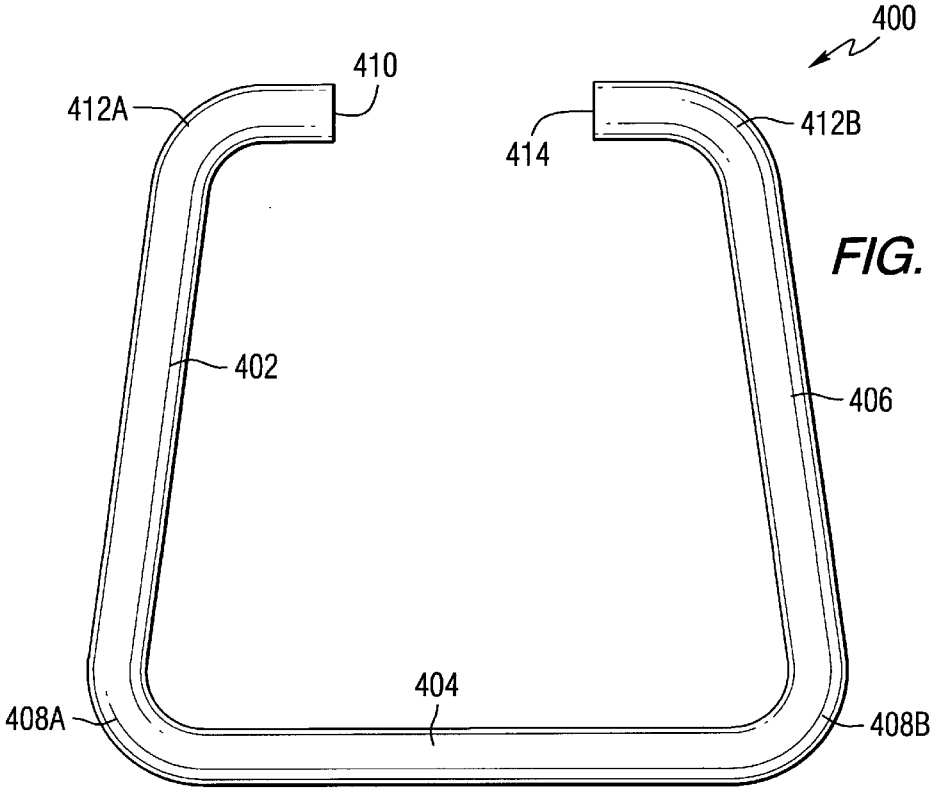
FIG. 12 is another orthogonal view of the spring clamp of the automatic trip assembly shown in FIG. 3.

Spring clamp 400 (FIGS. 11 and 12) is, in the exemplary embodiment, formed of stainless steel (17-7 stainless steel in the preferred embodiment because of its ability to withstand high temperatures) with a circular cross-section and a substantially uniform diameter of 0.030 to 0.040 inches (depending on the desired magnetic interruption rating, as described below). Other cross-sectional shapes and diameters of spring clamp 400, as well as other suitable materials (preferably high temperature materials), may be implemented in alternative embodiments. Clamp 400 includes substantially straight members 402, 404 and 406, each of approximately the same length in the exemplary embodiment. Member 402 is connected to member 404 via a tension elbow 408A, and member 404 is connected to member 406 via a tension elbow 408B. Clamp 400 also includes an end 410 that is connected to member 402 via an end portion elbow 412A, and an end 414 that is connected to member 406 via an end portion elbow 412B. End 410 is sized and shaped to correspond to indent 320 of clapper 256, and end 414 is sized and shaped to correspond to indent 299 of load terminal 28. As best seen in FIG. 12, tension elbow 408A of the exemplary embodiment is shaped to maintain an angle of less than 90 degrees between member 402 and member 404 when external forces are not exerted on clamp 400. Similarly, tension elbow 408B of the exemplary embodiment is shaped to maintain an angle of less than 90 degrees between member 406 and member 404 when external forces are not exerted on clamp 400. Other angles may be maintained in alternative embodiments.

Figure 3:
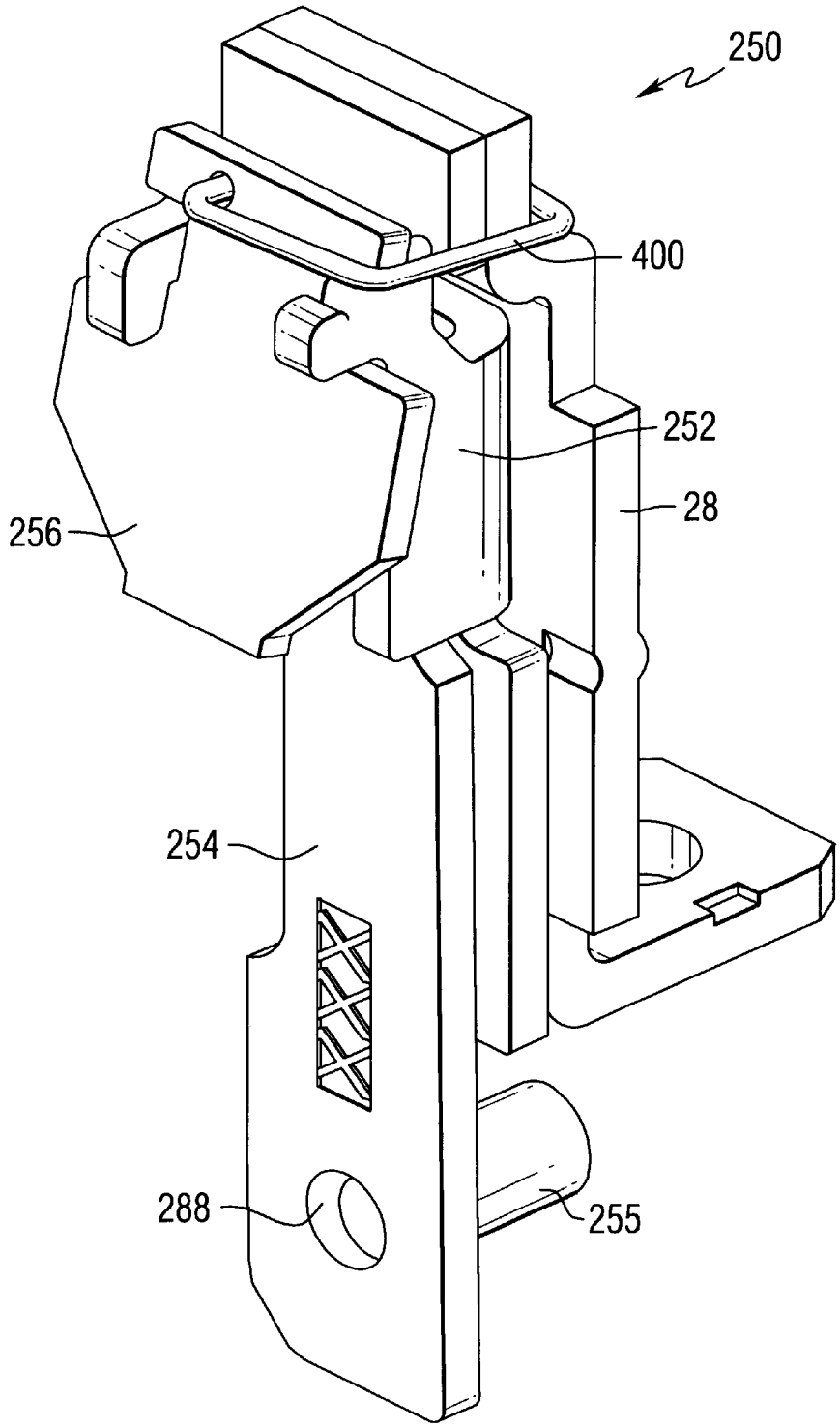
FIG. 3 is an orthogonal view of the automatic trip assembly of the trip mechanism of the circuit interrupter of FIG. 1.
Figure 4:
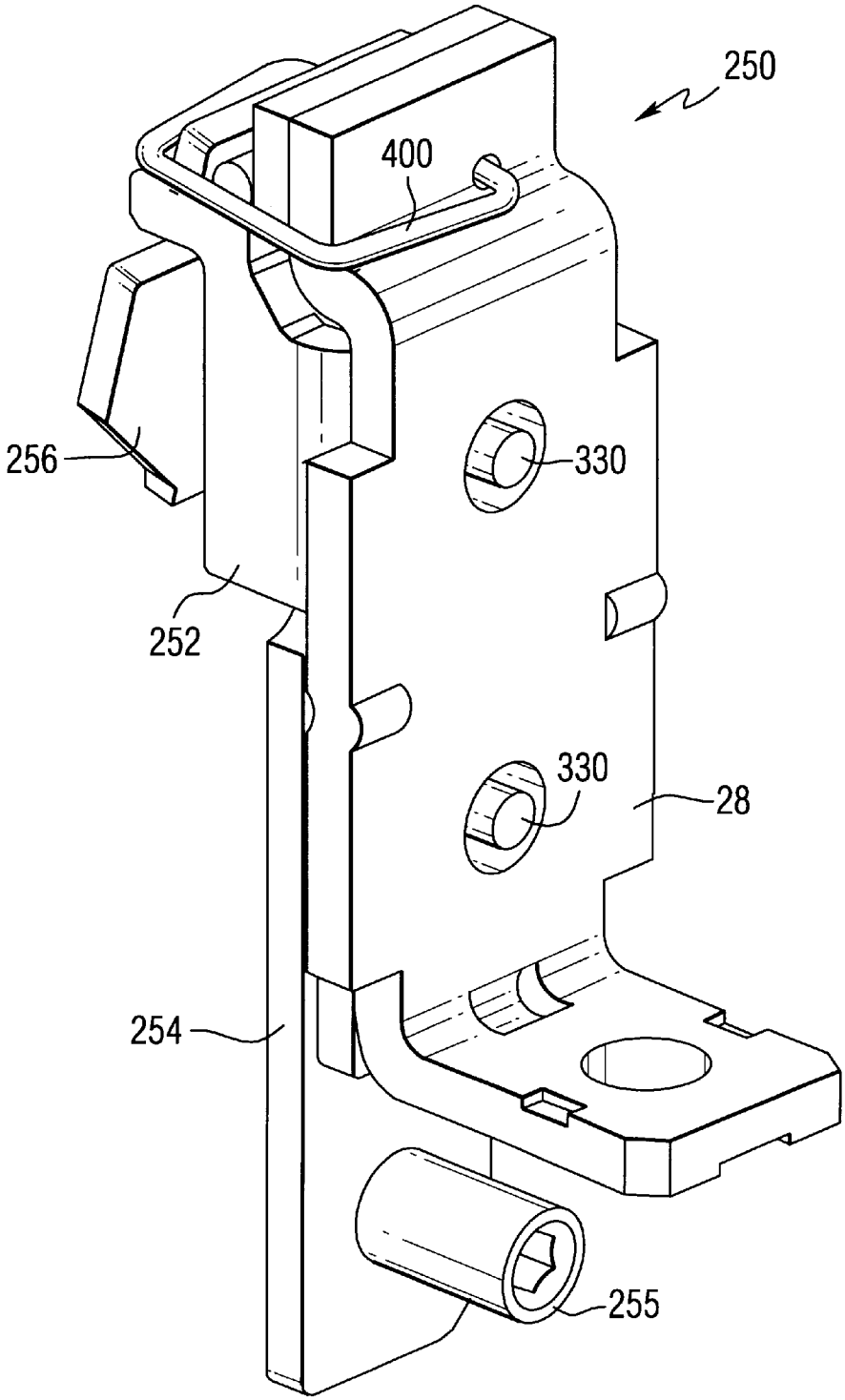
FIG. 4 is another orthogonal view of the automatic trip assembly shown in FIG. 3.
Figure 5:
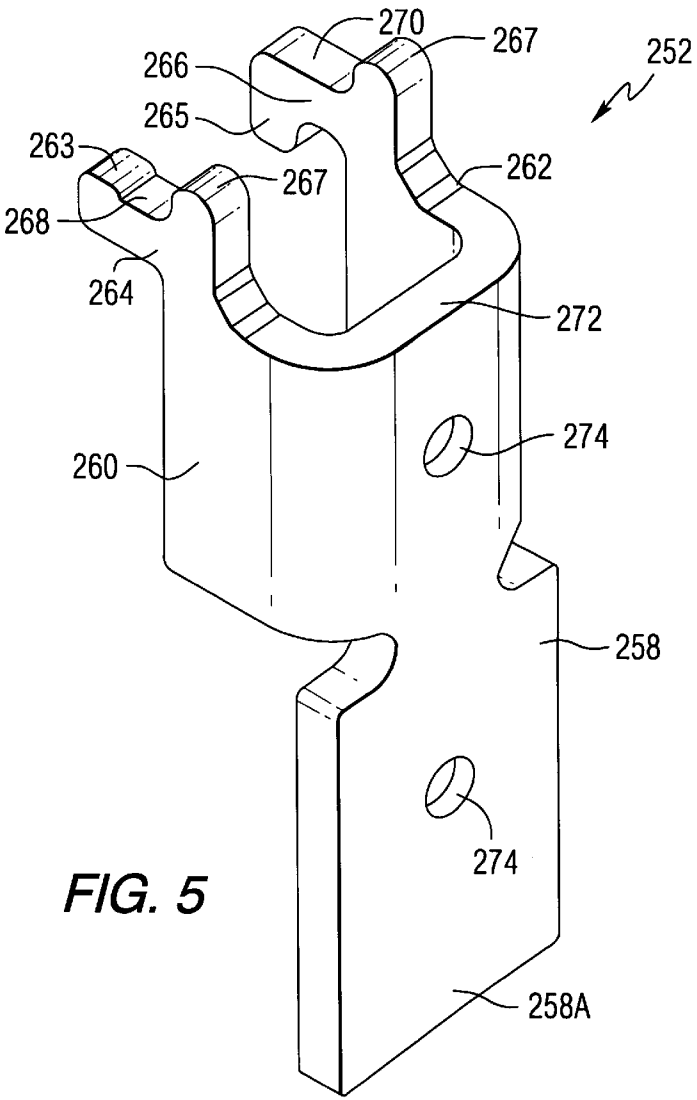
FIG. 5 is an orthogonal view of the magnetic yoke of the automatic trip assembly shown in FIG. 3.
Figure 6:
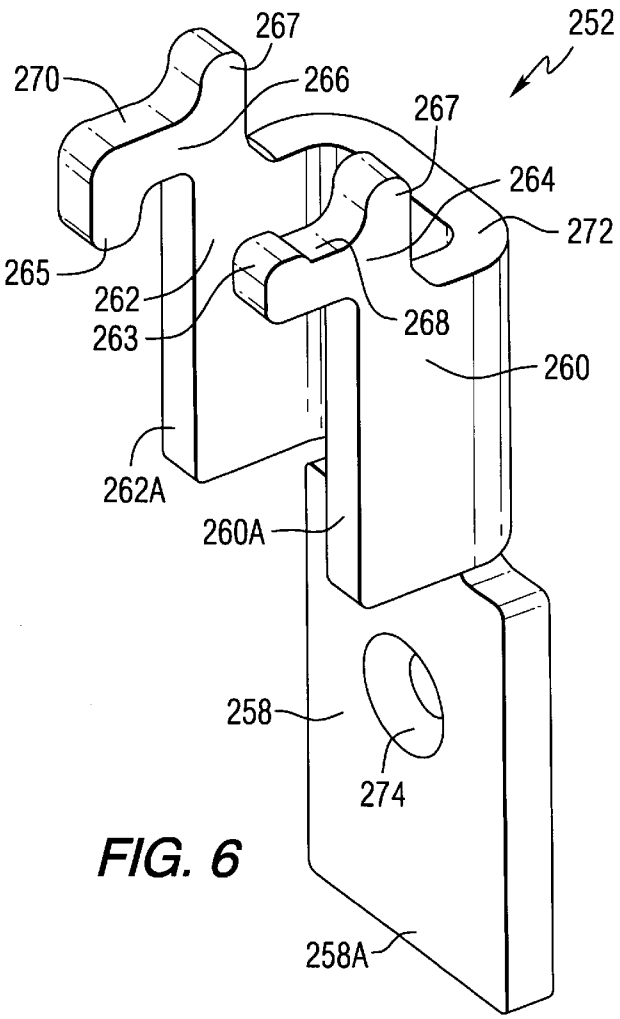
FIG. 6 is another orthogonal view of the magnetic yoke of the automatic trip assembly shown in FIG. 3.
Figure 7:
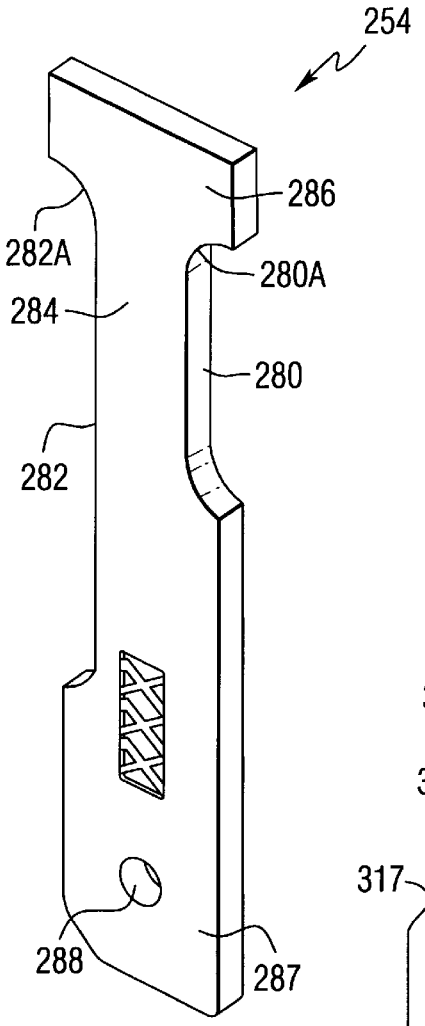
FIG. 7 is an orthogonal view of the bimetal of the automatic trip assembly shown in FIG. 3.
Figure 8:
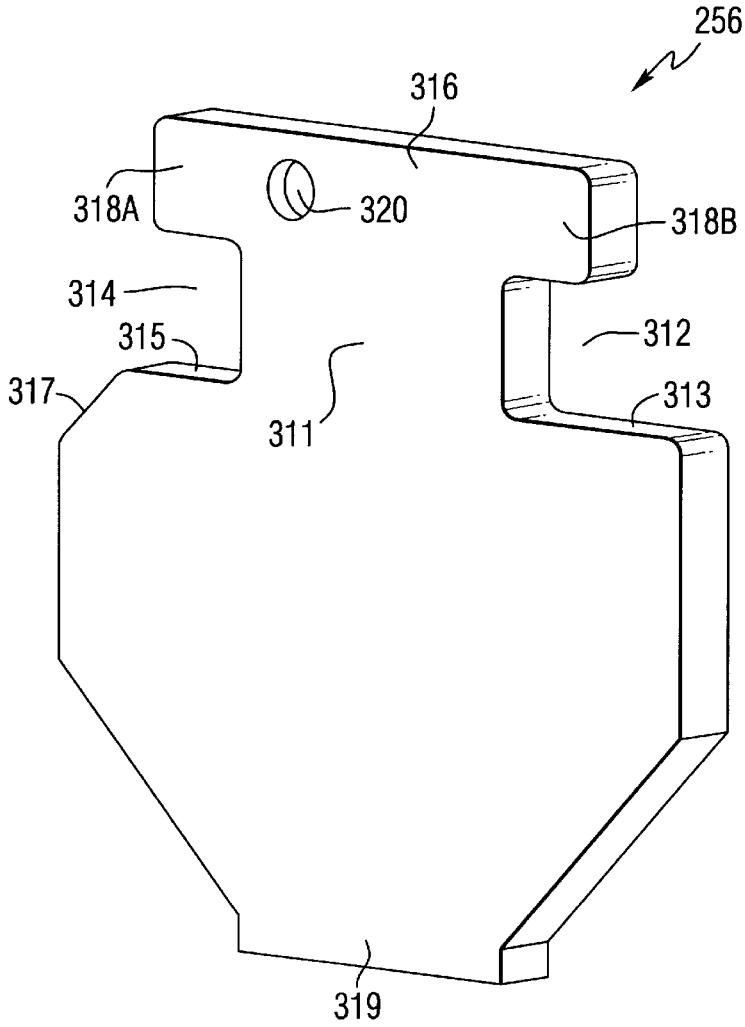
FIG. 8 is an orthogonal view of the armature of the automatic trip assembly shown in FIG. 3.
Figure 9:
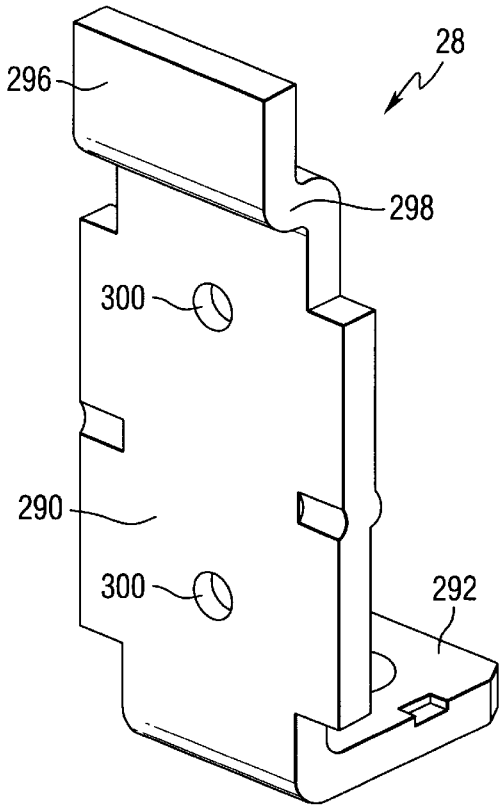
FIG. 9 is an orthogonal view of the load terminal of the automatic trip assembly shown in FIG. 3.
Figure 10:
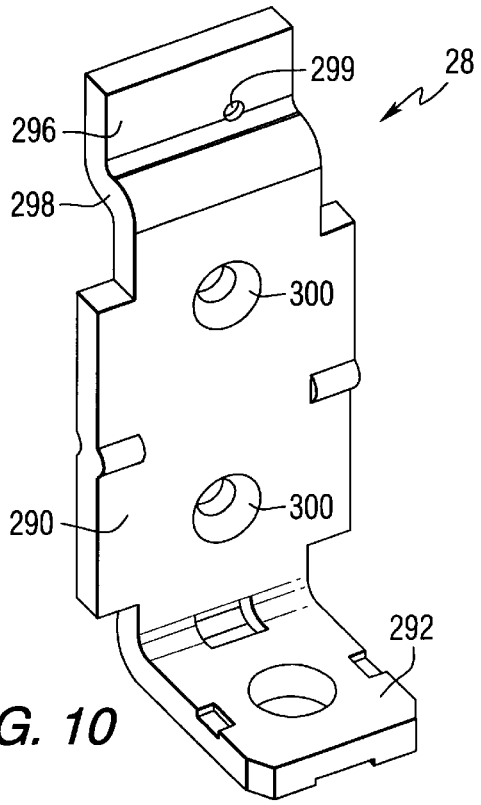
FIG. 10 is another orthogonal view of the load terminal of the automatic trip assembly shown in FIG. 3.
Figure 11:
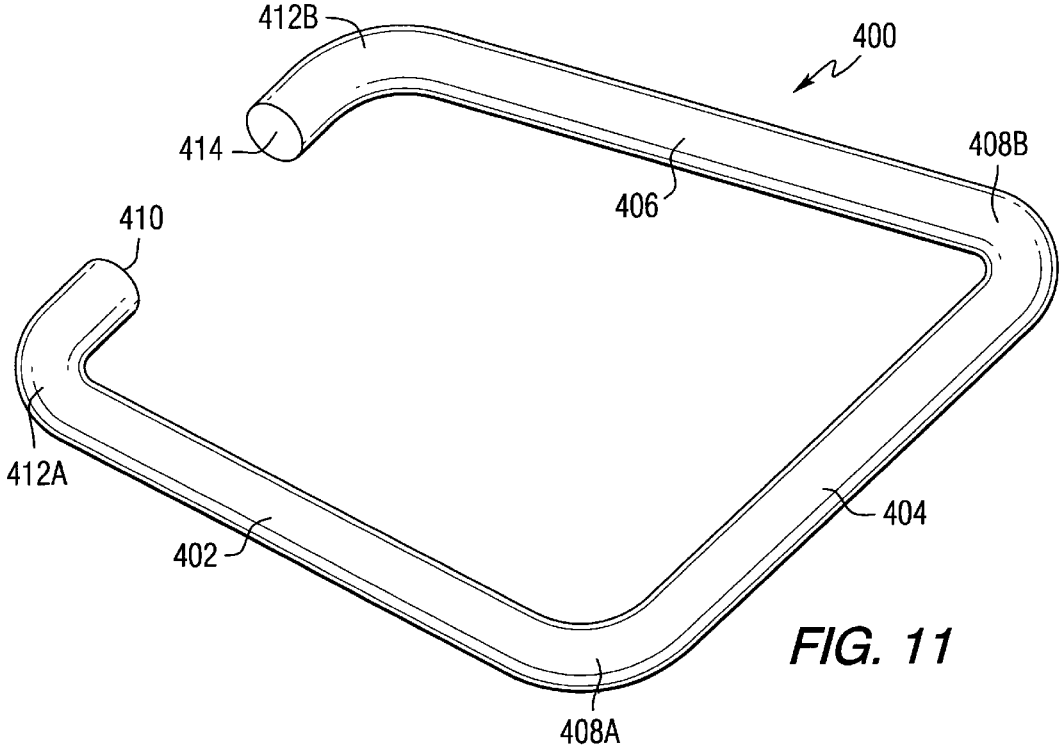
FIG. 11 is an orthogonal view of the spring clamp of the automatic trip assembly shown in FIG. 3.

FIGS. 3 and 4 show automatic trip assembly 250 in assembled form. Neck 284 of bimetal 254 is positioned between arms 260 and 262 of yoke 252 whereby bimetal 254 is substantially parallel (but not in contact) with portion 258 of yoke 252. A screw 255 is shown partially screwed into one side of opening 288 in bottom portion 287 of bimetal 254, for reasons discussed below. Head portion 286 of bimetal 254 is connected to top region 296 of load terminal 28 by way of a conventional heat welding or brazing process. Curved region 298 of load terminal 28 is positioned above shoulder 272 of yoke 252, with planar portion 290 of terminal 28 parallel and in contact with planar portion 258 of yoke 252. Securing terminal 28 to yoke 252 are securing devices such as rivets 330 which are inserted into holes 274 of yoke 252 and corresponding holes 300 of terminal 28. Positioned in contact with (seated in) pivot surfaces 268 and 270 of yoke 252 are pivot arms 318 of magnetic armature 256 for providing a limited range of motion of clapper 256, as discussed in more detail below. During operation of circuit breaker 10, retaining member 263 and retaining protrusions 267 of yoke 252 help maintain pivot arms 318 in contact with pivot surfaces 268 and 270.

Spring clamp 400 is positioned such that end 410 is seated in indent 320 of magnetic clapper 256, and end 414 is seated in indent 299 of load terminal 28. Clamp 400 is sized and configured such that the aforementioned positioning of ends 410 and 414 requires that ends 410 and 414 be separated a greater distance than they were originally. This increased separation of ends 410 and 414 increases the angle of separation between members 402 and 404 and the angle of separation between members 406 and 404, thereby placing elbows 408A and 408B in a tensioned state. The generated tension has a tendency to pull head portion 316 of magnetic clapper 256 in a direction towards head portion 286 of bimetal 254, which causes clapper 256 to be rotationally displaced in a clockwise manner (FIG. 2) from vertical whereby a predetermined distance is maintained between bottom portion 319 of clapper 256 and front faces 260A and 262A of magnetic yoke 252. As seen in FIG. 3, stop or protrusion 265 of pivot support 266 is positioned to make contact with a clockwise rotated clapper 256 (near shoulder 315), defining a maximum angle of rotational displacement of clapper 256. In order to conserve vertical space in circuit breaker 10, clamp 400 of the exemplary embodiment is swiveled such that elbow 408A is substantially adjacent to pivot arm 318B of clapper 256, and elbow 408B is substantially adjacent to curved region 298 of load terminal 28.

When implemented in circuit breaker 10 as shown in FIG. 2, automatic trip assembly 250 operates to cause a clockwise rotation of trip bar assembly 190, thereby releasing cradle 72 which leads to the TRIPPED disposition, whenever overcurrent conditions exist in the ON disposition. In the ON disposition as shown in FIG. 2, electrical current flows (in the following or opposite direction) from load terminal 28, through magnetic yoke 252 and bimetal 254, from bottom portion 287 of bimetal 254 to movable contact arm 50 through a conductive cord 289 (shown in FIG. 2) that is welded therebetween, through closed contacts 52 and 56, and from stationary contact arm 54 to line terminal 29. Automatic trip assembly 250 reacts to an undesirably high amount of electrical current flowing through it, providing both a thermal and a magnetic tripping operation.

The thermal tripping operation of automatic trip assembly 250 is attributable to the reaction of bimetal 254 to current flowing therethrough. The temperature of bimetal 254 is proportional to the magnitude of the electrical current. As current magnitude increases, the heat buildup in bimetal 254 has a tendency to cause bottom portion 287 to deflect (bend) to the left (as viewed in FIG. 2). When non-overcurrent conditions exist, this deflection is minimal. However, above a predetermined current level, the temperature of bimetal 254 will exceed a threshold temperature whereby the deflection of bimetal 254 causes bottom portion 287 to make contact with a thermal trip bar or member 194 (FIG. 2) of trip bar assembly 190. This contact forces assembly 190 to rotate in the clockwise direction, thereby releasing cradle 72 which leads to the TRIPPED disposition. The predetermined current level (overcurrent) that causes this thermal tripping operation can be adjusted in a conventional manner by changing the size and/or shape of bimetal 254. Furthermore, adjustment can be made by selectively screwing screw 255 (FIG. 3) farther into opening 288 such that it protrudes to a certain extent through the other side of bimetal 254 (towards thermal trip member 194). Protruding as such, screw 255 is positioned to more readily contact thermal trip member 194 (and thus rotate assembly 190) when bimetal 254 deflects, thus selectively reducing the amount of deflection that is necessary to cause the thermal tripping operation.

Automatic trip assembly 250 also provides a magnetic tripping operation. As electrical current flows through magnetic yoke 252, a magnetic field is created having a strength that is proportional to the magnitude of the current. This magnetic field generates an attractive force that has a tendency to pull magnetic clapper 256 towards front faces 260A and 262A of yoke 252. When non-overcurrent conditions exist, the tension provided by spring clamp 400 prevents any substantial rotation of clapper 256. However, above a predetermined current level, a threshold level magnetic field is created that overcomes the spring clamp tension, further separating ends 410 and 414 of clamp 400 and enabling bottom portion 319 of clapper 256 to forcefully rotate counter-clockwise towards front faces 260A and 262A of yoke 252. During this rotation, bottom portion 319 of clapper 256 makes contact with magnetic trip bar or member 196 which, as shown in FIG. 2, is partially positioned between clapper 256 and front faces 260A and 262A of yoke 252. This contact moves the end of trip bar 196 substantially between curved arms 260 and 262 of yoke 252, thereby forcing trip bar assembly 190 to rotate in the clockwise direction. This leads to the TRIPPED disposition. As with the thermal tripping operation, the predetermined current level that causes this magnetic tripping operation can be adjusted. Adjustment may be accomplished by implementation of a different sized or configured spring clamp 400, thereby reducing or increasing the spring clamp tension.

Although end 414 of spring clamp 400 is, in the exemplary embodiment described above, in contact with load terminal 28, it may instead be in contact with other solid structures within circuit breaker 10, such as a portion of housing 15, in alternative embodiments.

The spring clamp of the present invention provides an easy and cost-effective way by which to bias the armature away from the magnetic yoke. Although the preferred embodiment of the present invention has been described with a certain degree of particularity, various changes to form and detail may be made without departing from the spirit and scope of the invention as hereinafter claimed.

We claim:

1. A circuit interrupter comprising:

a housing;

separable main contacts within said housing;

an operating mechanism within said housing and interconnected with said separable main contacts; and a trip mechanism within said housing and having an automatic trip assembly for generating a tripping operation to cause said operating mechanism to open said contacts upon a predetermined current threshold, said automatic trip assembly including an armature and a main member comprising a magnetic yoke and an electrical terminal, said magnetic yoke having pivot supports on which are positioned pivot arms of a head portion of said armature, said head portion of said armature having a first contact area, said main member having a second contact area, said automatic trip assembly further including a clamp member having a first end positioned in contact with said first contact area and a second end positioned in contact with said second contact area, said clamp member applying a clamping force to said head portion of said armature in a direction to normally rotationally displace a bottom portion of said armature away from said yoke and said terminal.

2. The circuit interrupter as defined in claim 1 wherein said first contact area and said second contact area are each an indent.

3. The circuit interrupter as defined in claim 1 wherein said first contact area and said second contact area are each an opening.

4. The circuit interrupter as defined in claim 1 wherein said first end and said second end of said clamp member are bent inwardly towards each other.

5. The circuit interrupter as defined in claim 1 wherein said clamp member is U-shaped.

6. A circuit interrupter comprising:

a housing;

separable main contacts within said housing;

an operating mechanism within said housing and interconnected with said separable main contacts; and a trip mechanism within said housing and having an automatic trip assembly for generating a tripping operation to cause said operating mechanism to open said contacts upon a predetermined current threshold, said automatic trip assembly including a magnetic yoke, an armature, and an electrical terminal, said magnetic yoke having pivot supports on which are positioned pivot arms of a head portion of said armature, said head portion of said armature having a first contact indent, said electrical terminal having a second contact indent, said automatic trip assembly further including a spring clip having a first end positioned in said first contact indent and a second end positioned in said second contact indent, said spring clip applying a clamping force to said head portion of said armature in a direction to normally rotationally displace a bottom portion of said armature away from said yoke and said terminal.

7. The circuit interrupter as defined in claim 6 wherein said first end and said second end of said spring clip are bent inwardly towards each other.

8. The circuit interrupter as defined in claim 6 wherein said spring clip is U-shaped.

9. A circuit interrupter comprising:

a housing;

separable main contacts within said housing;

an operating mechanism within said housing and interconnected with said separable main contacts; and a trip mechanism means within said housing and having an automatic trip assembly means for generating a tripping operation to cause said operating mechanism to open said contacts upon a predetermined current threshold, said automatic trip assembly means including an armature means and a main member comprising a magnetic means and an electrical terminal, said magnetic means having pivot supports on which are positioned pivot means of a head portion of said armature means, said head portion of said armature means having a first contact area, said main member having a second contact area, said automatic trip assembly means further including a clamping means having a first end positioned in contact with said first contact area and a second end positioned in contact with said second contact area, said clamping means applying a clamping force to said head portion of said armature means in a direction to normally rotationally displace a bottom portion of said armature means away from said magnetic means and said terminal.

10. The circuit interrupter as defined in claim 1 wherein said second contact area is on said electrical terminal.

11. The circuit interrupter as defined in claim 9 wherein said first contact area and said second contact area are each an indent.

12. The circuit interrupter as defined in claim 9 wherein said first contact area and said second contact area are each an opening.

13. The circuit interrupter as defined in claim 9 wherein said first end and said second end of said clamping means are bent inwardly towards each other.

14. The circuit interrupter as defined in claim 9 wherein said clamping means is U-shaped.

* * * * *